US008627627B2

(12) United States Patent
Findlay

(10) Patent No.: US 8,627,627 B2
(45) Date of Patent: Jan. 14, 2014

(54) CONCRETE CASTING ELEMENTS

(75) Inventor: Donald Bruce Findlay, Buderim (AU)

(73) Assignee: DB & BA Finn Pty Ltd., Queensland (AU)

( * ) Notice: Subject to any disclaimer, the term of this patent is extended or adjusted under 35 U.S.C. 154(b) by 312 days.

(21) Appl. No.: 12/998,413

(22) PCT Filed: Oct. 19, 2009

(86) PCT No.: PCT/AU2009/001376
§ 371 (c)(1),
(2), (4) Date: Apr. 18, 2011

(87) PCT Pub. No.: WO2010/043003
PCT Pub. Date: Apr. 22, 2010

(65) Prior Publication Data

US 2011/0225919 A1 Sep. 22, 2011
US 2013/0232901 A2 Sep. 12, 2013

(30) Foreign Application Priority Data

Oct. 17, 2008 (AU) ..... 2008905398

(51) Int. Cl.
*E04B 1/68* (2006.01)
*E04D 13/15* (2006.01)

(52) U.S. Cl.
CPC ..... *E04B 1/68* (2013.01); *E04D 13/151* (2013.01)
USPC ..... 52/396.03; 52/396.05; 52/462

(58) Field of Classification Search
USPC ..... 52/396.02, 396.03, 396.05, 396.07, 52/461, 462, 470; 404/48–50, 55, 57, 58, 404/64, 65, 68
See application file for complete search history.

(56) References Cited

U.S. PATENT DOCUMENTS 3,296,762 A * 1/1967 Thom ..... 52/461
3,421,267 A * 1/1969 Reiff et al. ..... 52/396.07

(Continued)

FOREIGN PATENT DOCUMENTS

AU 2001/89350 11/2001
DE 19722028 12/1998

(Continued)

OTHER PUBLICATIONS

International Search Report and Written Opinion completed Feb. 23, 2010 and mailed Mar. 9, 2010 by the Australian Patent Office in counterpart international application No. PCT/AU2009/001376.

(Continued)

*Primary Examiner* — Mark Wendell
*Assistant Examiner* — Matthew J Smith
(74) *Attorney, Agent, or Firm* — Abelman, Frayne & Schwab

(57) ABSTRACT

Concrete casting elements for forming an expansion joint in concrete including: a pair of expansion joint members each having a gasket mounting formation to which a gasket may be mounted in operative interposition between the expansion joint members for sealing the joint; a flange extending from a remaining portion along one side of the expansion joint member and retainer mounting means formed onto or into said remaining portion for mounting one or more retainer elements to protrude from the opposite side of the expansion joint member from the flange; the flanges of each one of the expansion joint members being formed to engage one with the other; the flange of one joint member at least partly overlying the flange of the other to provide an expansion joint upper face and such that the remaining portions may be spaced from one another when the flanges are so engaged; the flange of the other expansion joint including a lip formed to be substantially coplanar with the expansion joint upper face; and the flanges also being formed and positioned for protection of the gasket against damage.

7 Claims, 10 Drawing Sheets

(56) References Cited

U.S. PATENT DOCUMENTS

| | | | | | |
|---|---|---|---|---|---|
| 3,474,589 | A | * | 10/1969 | Cheatwood | 52/698 |
| 4,904,111 | A | * | 2/1990 | Weisbach | 404/48 |
| 5,918,428 | A | | 7/1999 | Hough | |
| 6,598,364 | B1 | | 7/2003 | Jones et al. | |
| 7,845,131 | B2 | | 12/2010 | Hough | |
| 2008/0072504 | A1 | | 3/2008 | Hough | |

FOREIGN PATENT DOCUMENTS

| | | |
|---|---|---|
| GB | 1187498 | 4/1970 |
| GB | 1485950 | 9/1977 |
| JP | 2006/057411 | 3/2010 |
| WO | WO90/01600 | 2/1990 |
| WO | WO2007/021078 | 2/2007 |

OTHER PUBLICATIONS

International Preliminary Report on Patentability issued Apr. 19, 2011 by the International Bureau of WIPO in counterpart international application No. PCT/AU2009/001376.

* cited by examiner

CONCRETE CASTING ELEMENTS

CROSS-REFERENCE TO RELATED APPLICATIONS

This is a 371 of PCT/AU2009/001376, filed Oct. 19, 2009, which claims priority to Australian patent application No. 2008905398, filed Oct. 17, 2008, the disclosures of which are incorporated herein by reference in their entirety and made a part of this application.

FIELD OF INVENTION

This invention relates to concrete casting elements for concrete expansion joints. The invention has particular application to concrete casting elements for assisting in the forming of concrete slabs requiring expansion joints. However, the invention is not limited to this field of use.

BACKGROUND ART

When a concrete casting is poured, especially in the case of castings larger than a particular size, several castings are required to be made in succession. In each casting, cracks normally form after setting of the concrete as the concrete cures due to unavoidable shrinkage in the concrete. Because all castings shrink overall, adjoining castings are normally provided with an expansion joint. In order to produce slabs which are durable and functional, some elements which may be used to provide the formwork and the like become embedded in the concrete slab, and other elements are arranged outside the formwork and may be re-used in subsequent concrete castings. For convenience, in this specification, the term casting elements is to be taken to include all elements in or associated with the casting unless the context indicates otherwise.

One of the functions of casting elements is to provide for the placement of other casting elements within the concrete slab and/or expansion joint elements about the periphery of the slab at an elevation above the base of the slab. For example, casting elements known as bar chairs are used for the placement of reinforcing mesh and/or reinforcing bars in spaced relationship above the bottom of the slab so that in the cast concrete slab, such reinforcing is embedded inward by a predetermined spacing from the outer surfaces of the slab. Whilst bar chairs perform this function adequately, there are sometimes circumstances where the fixed height of bar chairs and/or their particular configuration make them unsuitable for spacing casting elements above the base of the slab, even if the other casting elements include reinforcing bars.

Concrete slabs generally, and roadways in particular, are difficult to seal properly against the elements. The simplest way of making expansion joints is to first pour a whole concrete slab and then, as setting has begun, divide it into smaller sections separated by grooves saw-cut on the surface of the slab by means of a diamond-blade saw. Subsequent contraction cracks will then appear at the grooves. The edges of saw-cut expansion joints are prone to crumbling and chipping, so they are not suitable for some applications. Saw-cutting the expansion joint adds to the cost on construction. It is normally important that such joint be sealed against moisture and flooding to avoid erosion of the substrate or foundation by insertion of a sealant into the joint.

Sealants are not usually installed in concrete slabs until such slabs are 28 days old because concrete shrinks while curing, most shrinkage occurring in the first 28 days from casting. This can result in joint opposing faces becoming contaminated and hard to adhere to. Construction timetables can be difficult to maintain, particularly if weather conditions do not leave the job in a dry condition required for continuation.

Shrinkage can occur after placing sealant and for twelve months or longer after the initial casting. Although sealants are designed to expand and contract, there is a mechanical limit to the extent of expansion. For example, 2 mm of shrinkage in a 10 mm wide joint would result in sealant failure. Moreover, if sealants are left in extension for an extended period of time, the sealant may also fail. One approach has been to make contraction cracks wider so that the proportionate expansion of the crack is less. For example, cracks up to 20 mm wide have been tried, but these do not always work. Moreover, such wide contraction cracks and expansion joints may result in a surface unsatisfactory for wheeled vehicles travelling across the expansion joint.

Conventional expansion and construction joints are traditionally made using timber former to form an edge. After pouring, screeding and sometimes further shaping the concrete into its final form, the concrete is allowed to set. The form work is removed some time after setting of the concrete. Once initial shrinkage has taken place the joint former, for example, styrene or other flexible foam joint expansion material, such as Ableflex® brand elastomeric adhesive is glued to the edge. Then the second slab is placed using the concrete upper edge of the previously cast slab as an aid or guide for screeding the next slab. After 28 days the styrene is removed and the joints are sealed with a flexible sealing agent.

The casting element often used for expansion joints may be referred to as an expansion joint element and is typically formed from metal sheeting with a channel running its length. The channel provides a corresponding ridge on the face of the sheeting opposite the channel. Of course, instead of a channel, one or more concavities of other form may be formed into one or both faces, each concavity thus forming a corresponding convexity protruding outward from the opposite face of the sheeting, so long as the concavities and convexities permit the adjoining edges of cast concrete slabs to move towards and away from one another in substantial alignment with their general planarity. In this specification, unless the context indicates otherwise, the term key former will be used to refer to such expansion joint elements.

Expansion joints formed with a key former still have problems associated with sealing. For example, the key former can interfere with the installation of a sealant in a number of ways. An expansion joint caused solely by the shrinkage of concrete may be too narrow for a sealing agent to be installed, with the result that the expansion joint may not be watertight.

In this specification, terms indicating elevational disposition such as upper, lower, top, bottom, horizontal and vertical may be used to refer to features, parts, portions or the like of the casting elements in their normal orientation, and are not to be taken to limit the use of the casting elements of the present invention to any particular orientation, whether or not in use.

The present invention aims to provide one or more types of concrete casting element which alleviate one or more of the problems associated with concrete castings. Other aims and advantages of the invention may become apparent from the following description.

DISCLOSURE OF THE INVENTION

With the foregoing in view, this invention in one aspect resides broadly in concrete casting elements for forming an expansion joint in concrete including:

a pair of expansion joint members each having a gasket mounting formation to which a gasket may be mounted in operative interposition between the expansion joint members for sealing the joint;

a flange extending from a remaining portion along one side of the expansion joint member and retainer mounting means formed onto or into said remaining portion for mounting one or more retainer elements to protrude from the opposite side of the expansion joint member from the flange;

the flanges of each one of the expansion joint members being formed to engage one with the other;

the flange of one joint member at least partly overlying the flange of the other to provide an expansion joint upper face and such that the remaining portions may be spaced from one another when the flanges are so engaged;

the flange of the other expansion joint including a lip formed to be substantially coplanar with the expansion joint upper face; and the flanges also being formed and positioned for protection of the gasket against damage.

In such form, the flanges may slide against one another face-to-face to accommodate the joint members moving towards and away from one another. Preferably, the retainer mounting means is formed as a groove, slot or channel, hereinafter termed a retainer channel, into which a complementary retainer mounting formation may be inserted. The form and/or orientation of the retainer channel are selected to limit the movement of the retainer element towards and away from the expansion joint member whereby the retainer element may retain the expansion joint members in substantially fixed disposition in a concrete slab into which the retainer element is be cast.

In another aspect, the present invention resides broadly in concrete casting elements for forming an expansion joint in concrete including:

an expansion joint recess member having a recess portion extending from a remaining portion along one side of the expansion joint recess member and having an elongate recess opening to the side from which the recess portion extends and retainer mounting means for mounting one or more retainer elements to protrude from the opposite side of the recess member from the opening of the recess;

an expansion joint flange member having a flange extending from a remaining portion along one side of the expansion joint member and retainer mounting means for mounting one or more retainer elements to protrude from the opposite side of the flange member from the flange;

a mounting groove extending along an edge of either or each of the expansion joint socket member and expansion joint spigot member for mounting either expansion joint member to a side edge of a key former, the flange being formed to have a cross-section complementary to the elongate recess whereby the flange may be inserted into and withdrawn from the recess as the expansion joint members move towards and away from one another in a substantially parallel relative disposition with respect to one another.

In such form, and the expansion joint flange member constitutes the other expansion joint member having the lip substantially coplanar with the expansion joint upper face.

In another aspect, the present invention resides broadly in concrete casting elements for forming an expansion joint in concrete including:

an expansion joint recess member having a recess portion extending from a remaining portion along one side of the expansion joint recess member and having an elongate recess opening to the side from which the recess portion extends and retainer mounting means for mounting one or more retainer elements to protrude from the opposite side of the recess member from the opening of the recess;

an expansion joint flange member having a flange extending from a remaining portion along one side of the expansion joint member and retainer mounting means for mounting one or more retainer elements to protrude from the opposite side of the flange member from the flange;

a mounting groove extending along an edge of either or each of the expansion joint socket member and expansion joint spigot member for mounting either expansion joint member to a side edge of a key former, and a substantially straight edge formed along either or both the joint recess member and the joint flange member at a disposition suitable for use as a screed rail.

In another aspect, the present invention resides broadly in concrete casting elements for forming an expansion joint in concrete including:

an expansion joint recess member having a recess portion extending from a remaining portion along one side of the expansion joint recess member and having an elongate recess opening to the side from which the recess portion extends and retainer mounting means for mounting one or more retainer elements to protrude from the opposite side of the recess member from the opening of the recess;

an expansion joint flange member having a flange extending from a remaining portion along one side of the expansion joint member and retainer mounting means for mounting one or more retainer elements to protrude from the opposite side of the flange member from the flange;

a mounting groove extending along an edge of either or each of the expansion joint socket member and expansion joint spigot member for mounting either expansion joint member to a side edge of a key former, and a sealant receiving formation extending substantially along the joint recess member and the joint flange member in respect of which a water-expandable sealant may be received to be operatively disposed in the expansion joint.

Preferably, the recess portion is formed from a pair of opposed flanges, an outer flange and an inner flange, each substantially parallel to the other. In such form, the outer flange corresponds to the flange described with reference to the pair of expansion joint members. The inner face of the outer flange of the expansion joint recess member thus is engageable with the outer face of the flange of the expansion joint flange member. However, in a preferred form, the inner flange of the expansion joint recess member includes a gasket mounting formation to which a gasket may be mounted for sealing the joint.

It is also preferred that the retainer mounting means be formed as a retainer channel as hereinbefore described and into which a complementary retainer mounting formation may be inserted. In some applications, it is also preferred that one of the expansion joint members be supported at a predetermined elevation above the concreting base.

In another aspect, the present invention resides broadly in a casting element support assembly for supporting one or more other casting elements at a selectable elevation above the base of a slab including:

a base portion having;

an attachment formation formed thereon or therein and an engagement formation formed onto or into the base portion in operative disposition with respect to the attachment formation and a mounting portion having a complementary attachment formation formed thereon or therein for detachably attaching the mounting portion to the base portion, a complementary engagement formation in operative disposition with respect to the complementary attachment formation for operative engagement of the mounting portion to the base portion at any one of a plurality of positions and one or more mounting formations for mounting a casting elements thereto; and wherein the respective formations are arranged such that when the mounting portion is attached to the base portion, it is also engaged with the base portion is in fixed disposition with respect to the base portion.

Preferably, the attachment formation and complementary attachment formation provide for an interference fit of the complementary parts, such as spigot and socket, tongue and groove, flange and channel or such like. Preferably, the attachment formation is in the form of a channel having a lipped opening, and the complementary attachment formation is in the form of a lipped flange, the lips of the opening and the flange being sized for an interference fit. In such form, lips of the channel and flange are arranged such that the flange is retained in the channel when so inserted.

Preferably, the engagement and complementary engagement formations include complementary keyed faces, hereinafter termed engagement faces, such that when the mounting portion is attached to the base portion, their respective keyed faces engage face-to-face. The complementary keyed faces are formed such that the mounting portion cannot slide along the side of the base portion when the mounting portion is attached to the base portion.

In a preferred form, the complementary keyed faces include a plurality of ridges and grooves of complementary cross-section running orthogonally to the channel and flange of the attachment formation and complementary attachment formation. The mounting formations or formations on the mounting portion may thus have another casting element, such as an expansion joint member hereinbefore described mounted thereto at a selected position above the base of the casting.

BRIEF DESCRIPTION OF THE DRAWINGS

In order that the invention may be more readily understood and put into practical effect, one or more preferred embodiments of the present invention will now be described with reference to the following drawings, and wherein.

DETAILED DESCRIPTION OF THE DRAWINGS

Figure 1:
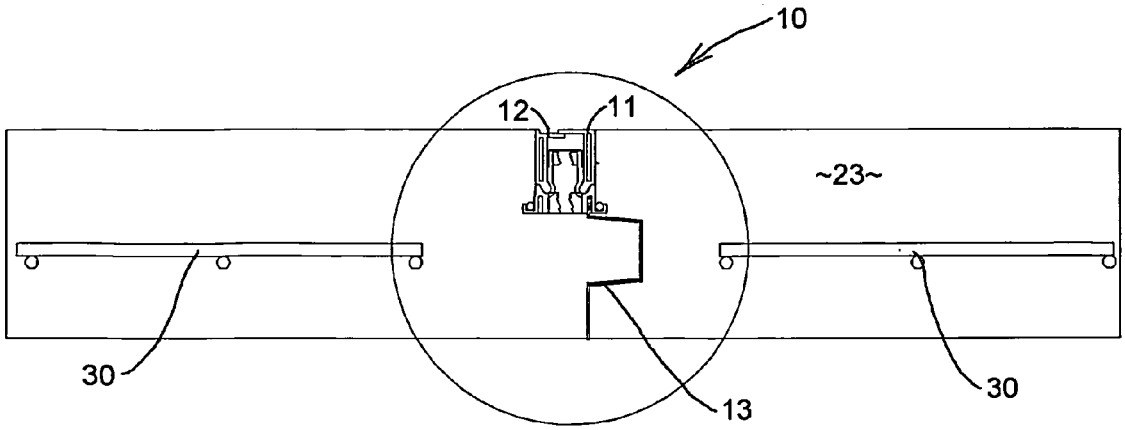
FIG. 1 is a cross section of casting elements for an expansion joint according to the invention.
Figure 2:
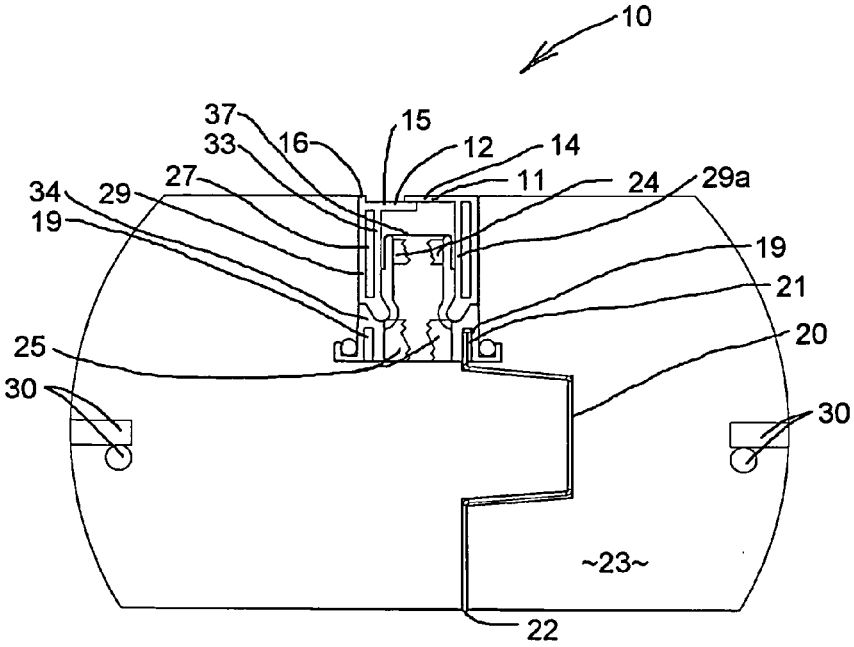
FIG. 2 shows the casting elements of FIG. 1 in more detail.
Figure 3:
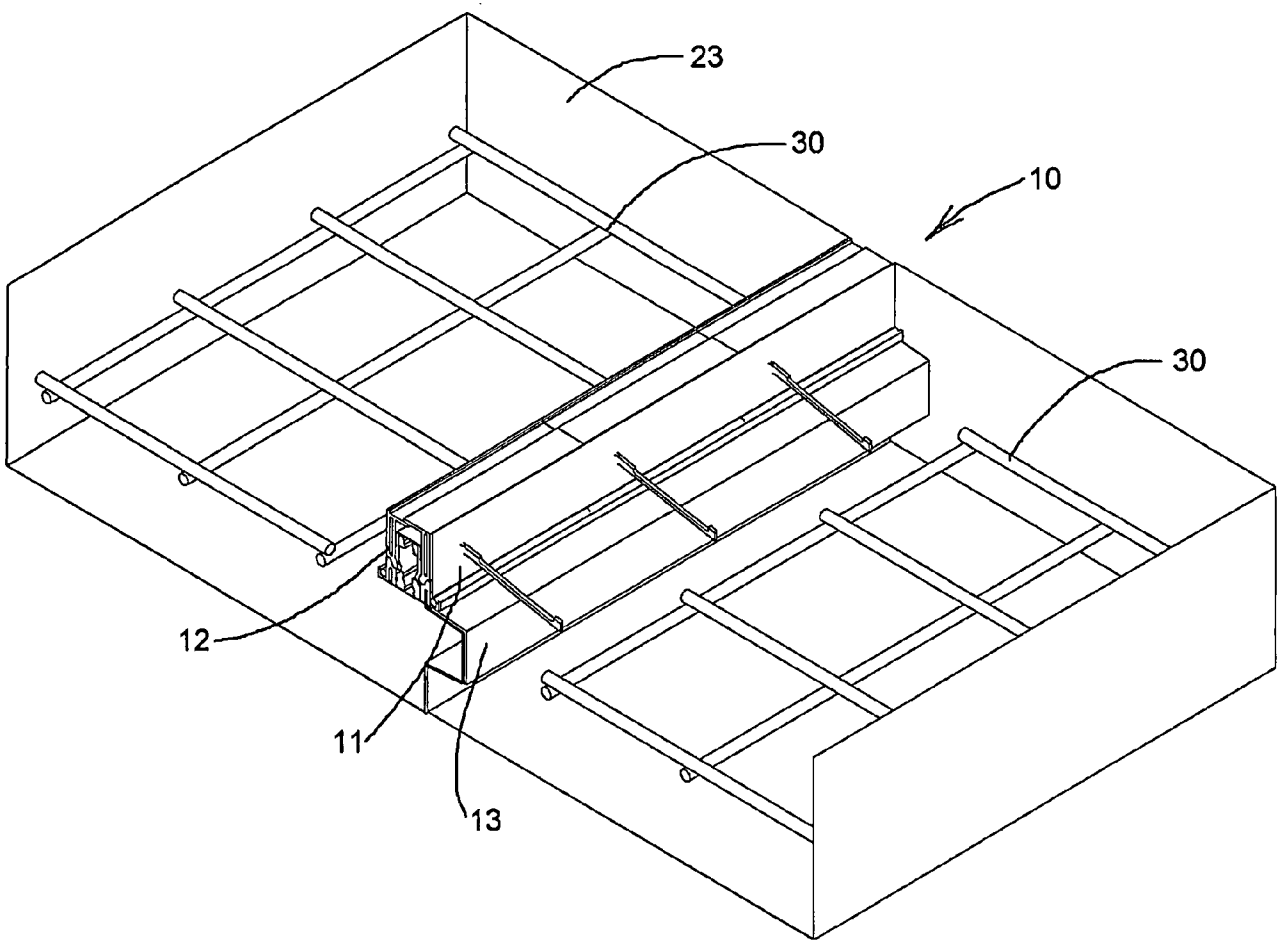
FIG. 3 is a diagrammatic pictorial view of the casting elements of FIGS. 1 and 2 embedded in a concrete casting.

The casting elements for an expansion joint shown generally at 10 shown in FIGS. 1 to 6 includes a socket member 11 and spigot member 12 engaged therewith. The expansion joint also includes a key former 13 having a displaced portion 20 interposed between an upper lip 21 and a lower lip 22. In FIG. 3, the key former is shown embedded in a concrete slab 23. The displaced portion of the key former is trapezoidal in form, the shorter parallel side of the displaced portion forming a flat face substantially parallel to the faces of the upper and lower lips, and joined thereto by the sloping sides of the trapezoidal form. In the orientation shown in FIG. 2, the channel side of the key former is to the left such that the concrete slab will have a ridge projecting outward to the right to be received in a channel set in towards the right of the adjoining part of the concrete slab.

The provision of the displaced portion permits the left hand and right hand portions of the concrete slab to move towards and away from one another whilst remaining in substantial alignment with one another in their dominant plane. The lower lip of the key former is normally placed on the bottom of the form work into which the concrete is cast to form the concrete slab. Reinforcing bars 30 are embedded in the concrete slab in the form of a reinforcing wire mesh. Reinforcing bars may be provided penetrating through the key former to extend into adjoining castings, known in the art as dowel bars. One or more penetrations are provided through the sides of the channel to permit a bar to be inserted through the channel, transverse to same, thereby permitting the key former to be positioned at a desired height in the casting.

The spigot and socket members each include a slot 19 extending up into the underside of the respective members for engaging with the upper lip 21 of the key former 13. In the example shown in the drawings, the key former is engaged in the slot of the socket member 11. Each member also includes a side web 29 extending vertically upward to provide a side passage 27 closed at the top and bottom and being narrow across, about the same in width as the width of the side web. An inside web 29*a* is provided substantially parallel to the side web to provide the inside wall of the side passage. Some of the elements described in respect of the spigot member will likewise be found on the opposite side of the socket member and vice versa. For clarity, however, not all of the reference numerals for such portions are provided in the drawings to avoid cluttering of the drawings.

The spigot member 12 includes an under flange 15 extending towards the socket member substantially horizontally in its normal orientation and placement in relation to the socket member. In similar fashion, the socket member includes a top flange 14 extending towards the spigot member. The under flange of the spigot member slides under the top flange of the socket member, the upper face of the under flange sliding under the lower face of the top flange. A socket is effectively formed between the underside of the top flange and the remainder of the socket member. The top flange extends towards the spigot member when the socket and spigot members are in their engaged disposition with respect to one another. The under flange has a proximal lip 16 extending along its proximal edge and extending upward to the same level as the upper face of the top flange.

An optional casting seal 24 is interposed between the main webs of the spigot and socket members, the casting seal normally breaking, as shown, after expansion of the joint due to the expected shrinkage of the concrete after casting. A further optional seal 25 is provided between the lower extremities of the spigot and socket members, again shown in a broken condition due to the expected shrinkage of the concrete after casting.

A strip of sealing tape 37 is provided and bonded into place along its edge portions to the spigot and socket members by a bonding agent. The sealing tape is a strip of flexible material that is chemical and heat resistant. The two parts are provided to permit assembly of the joint members including the installation of the sealing tape. The optional casting seal and further optional seals are formed from a hydrophilic material selected for desirable properties in sealing a concrete crack including materials known in the art. The material selected is coated with a temporary hydrophobic coating formulated to dissolve, dissipate or disperse after a predetermined elapse of time after the installation of the cracking strip in a concrete slab.

Figure 6:
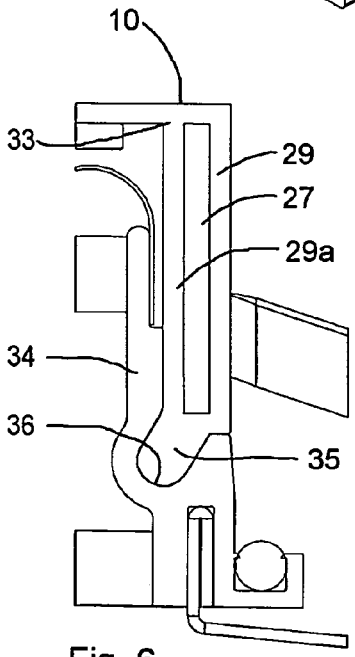
FIG. 6 shows the expansion joint of FIG. 5 in more detail.
Figure 7:
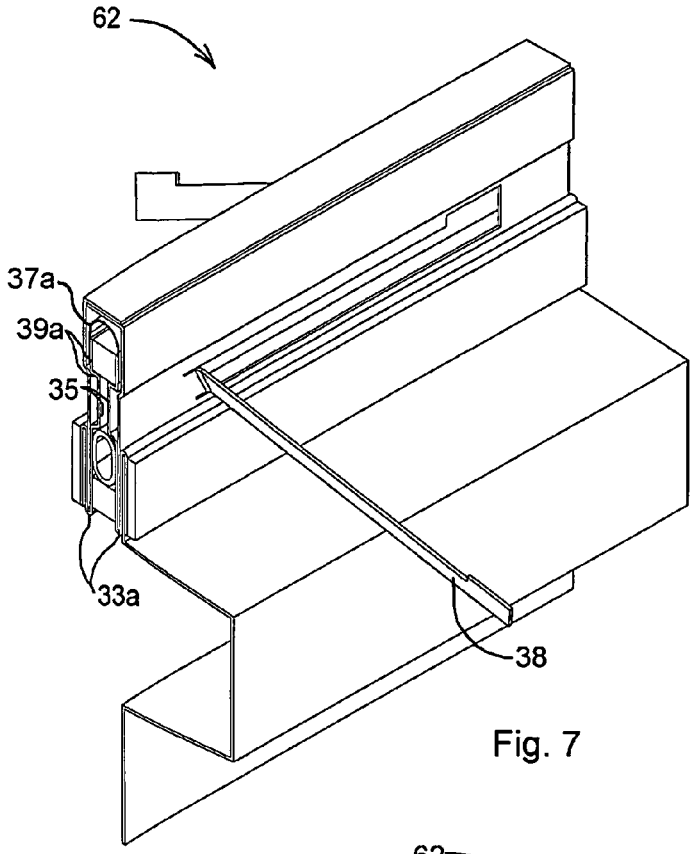
FIG. 7 is a pictorial view of alternative casting elements for an expansion joint formed from sheet metal having integral anchors according to the invention.
Figure 9:
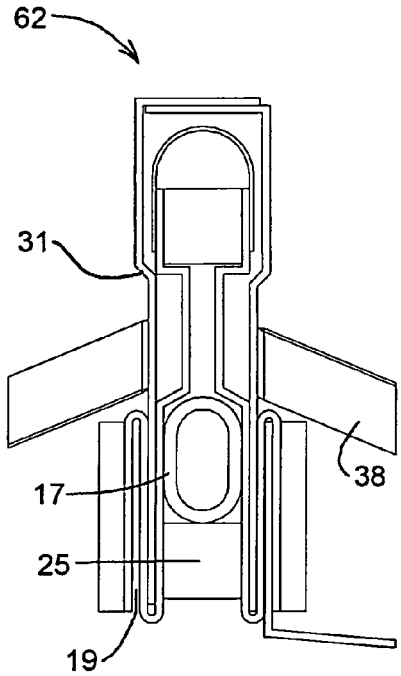
FIG. 9 shows the expansion joint of FIG. 8 in more detail.
Figure 8:
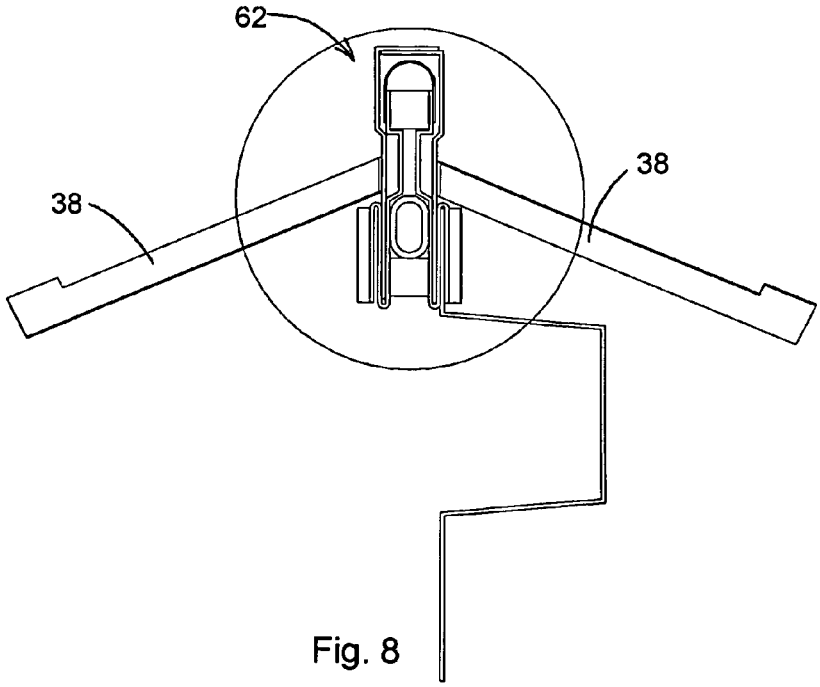
FIG. 8 is a cross-section of the expansion joint formed from sheet metal of FIG. 7.
Figure 10:
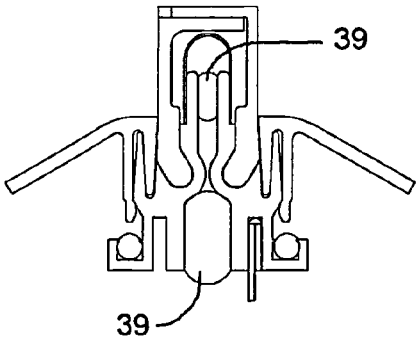
FIGS. 10 to 13 show in cross-section an expansion joint in various states of expansion.
Figure 11:
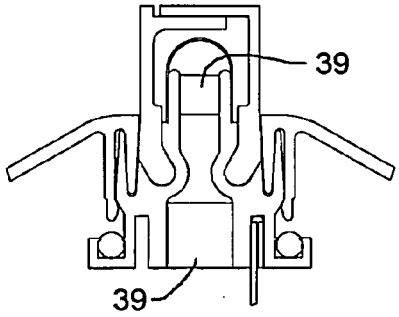
Figure 12:
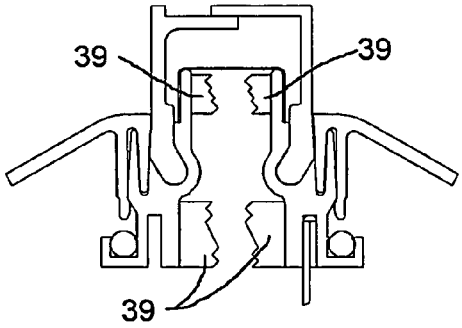
Figure 13:
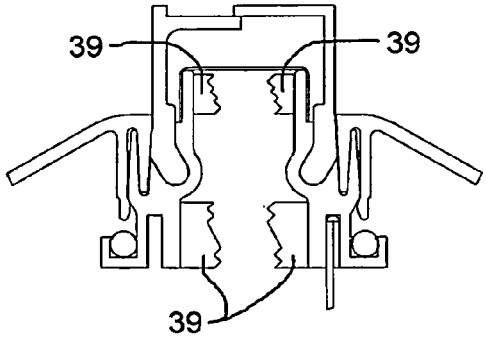
Figure 22:
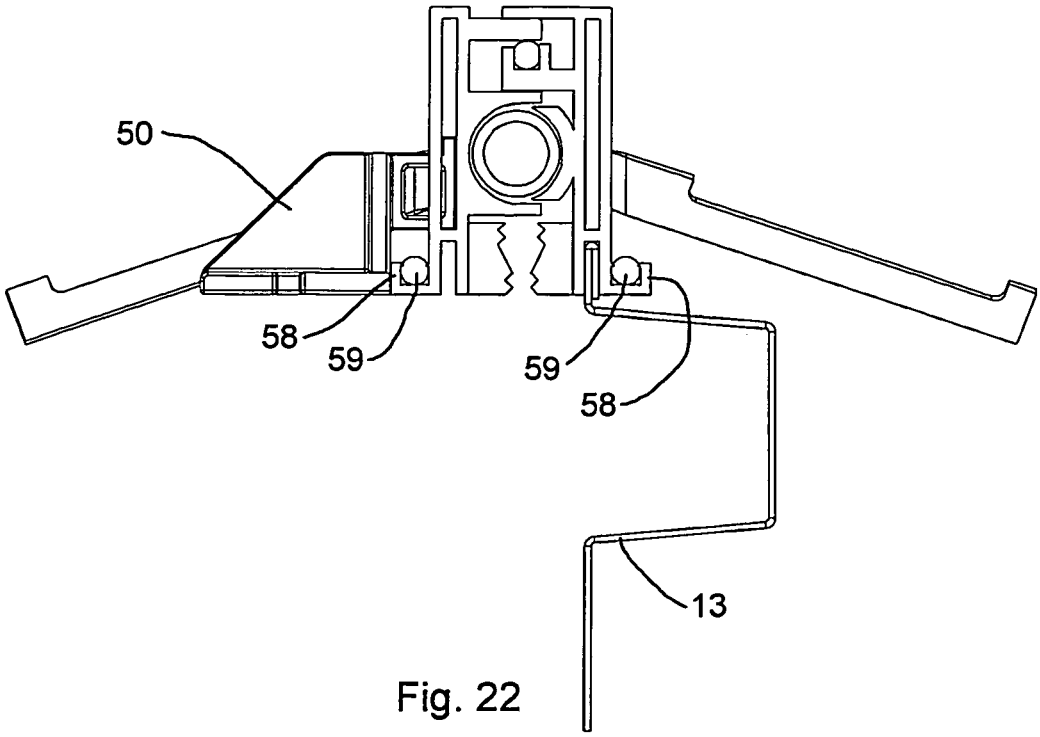
FIG. 22 is a pictorial view of the nail clip of FIG. 20 in use with an expansion joint with integral anchors and key former.
Figure 23:
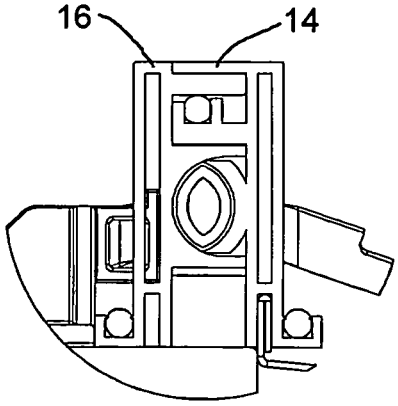
FIG. 23 is a cross-section of the nail clip and alternative expansion joint with integral anchors of FIG. 22.
Figure 24:
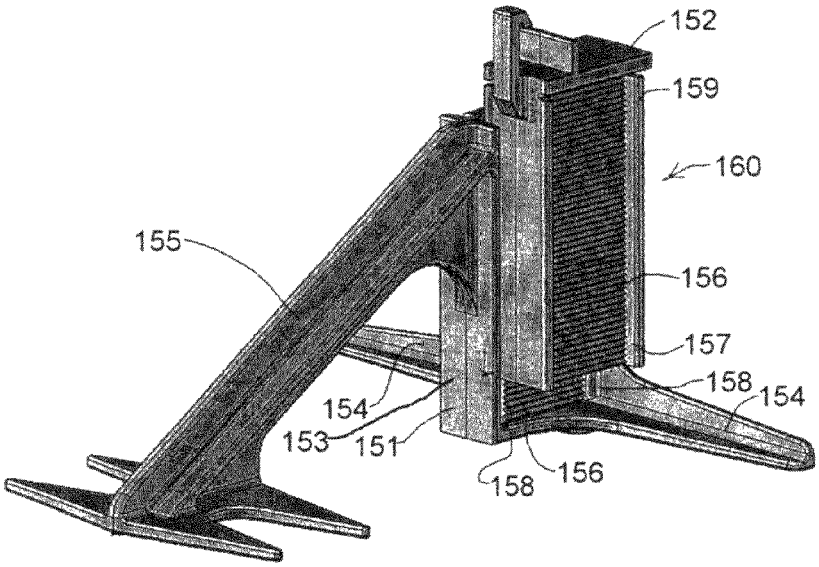
FIG. 24 is a pictorial view of casting elements for a form setter according to the invention.

The casting elements for the alternative expansion joint 40 shown in FIGS. 7 to 9 are the same in many respects to the casting elements described with reference to FIGS. 1 to 6. Accordingly, the same reference numerals are used to refer to like parts. The joint includes the key former 13, but the spigot and socket members are substituted by alternative spigot and socket members, these terms being selected for convenience only since it will be appreciated that corresponding formations to the spigot and socket of the expansion joint shown in FIGS. 1 to 6 are provided in an alternative form. In such form, the alternative socket member is still provided with the top flange 14 and the alternative spigot member is provided with the under flange 15, but the closing flange is absent from the socket member. Being formed by roll forming from sheet metal, the alternative spigot member does not include the proximal lip. It can be seen, particularly in FIG. 22, where the expansion joint is closed up, that the upper face of the top flange is substantially coplanar with the upper face of the proximal lip.

The alternative expansion joint also includes a hollow gasket 17 mounted above the further optional seal between the folds of material forming the remainder of the apparatus. The hollow gasket may be formed from swellable material. Additionally, or on the alternative, a swellable material may be introduced onto the hollow bore extending through the hollow gasket.

Each member is also provided in two parts, an upper part 33 and a lower part 34. As in the case of the expansion joint shown in FIGS. 1 to 5, the socket and spigot members are provided as a pair in opposite handed form but for the positioning of the top and under flanges and the inclusion of the proximal lip along the top of the spigot member. The upper face of the under flange of the spigot member can slide against the lower face of the top flange of the socket member.

Figure 4:
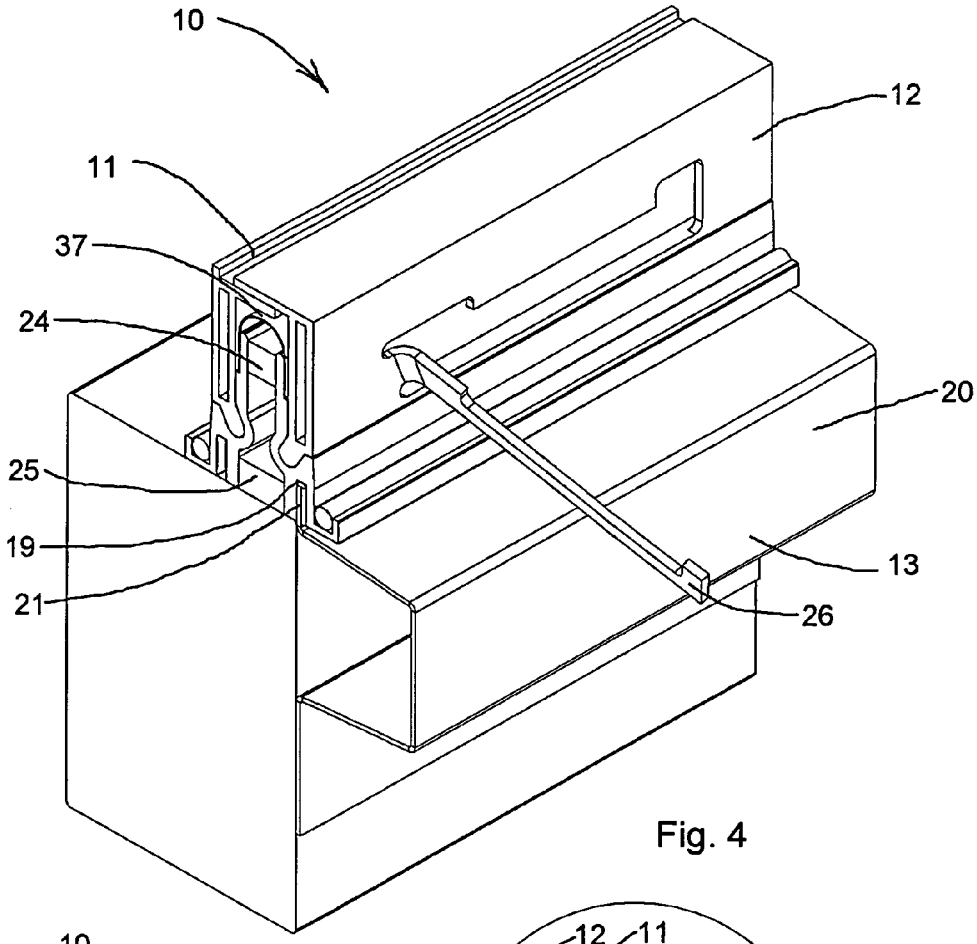
FIG. 4 is a pictorial view of casting elements for the expansion joint of FIGS. 1 and 2 in a non-expanded condition.
Figure 5:
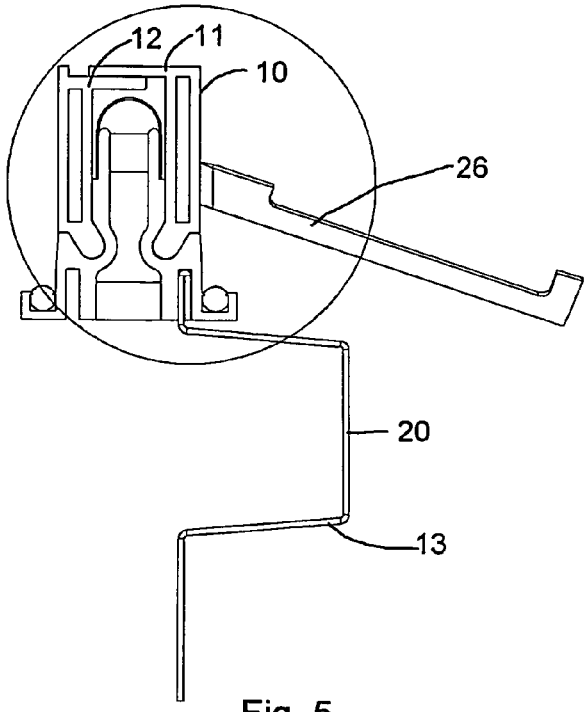
FIG. 5 is a cross-section of the alternative expansion joint of FIG. 4.

An anchoring element 26 is divided from the body of the expansion joint members as shown in particular in FIGS. 4 to 6, each anchoring element formation being provided to for keyed engagement in the concrete slab to substantially prevent withdrawal of the anchoring element or portion from the concrete slab. Additionally, the anchoring element is provided at an angle to the dominant plane of the slab to ensure that the anchor is not too close to the surface of the slab, thereby avoiding the possibility that the anchor contributes to failure of the slab. The angle of the anchoring elements also provides additional anchoring.

Figure 19:
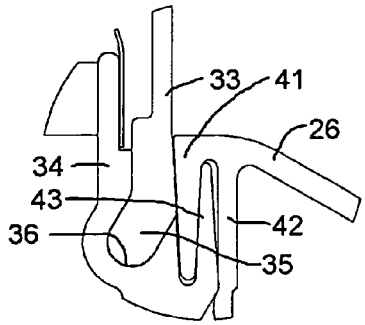
FIG. 19 is shows the expansion joint of FIG. 18 in more detail.

Detail of the engagement of the upper and lower parts of the alternative spigot and socket members is provided in FIGS. 6 and 19. The upper and lower parts are engaged with one another by the provision of an angled edge portion 35 on each side of the upper part which is insertable into an angled channel 36 in each side of the lower part. The angled edge portion includes a rounded distal edge complementary in form to a rounded base of the angled channel. In FIG. 19 the detail of a side web 29 and its engagement in the complementary slot 28 of the anchoring element can also be seen. It can also be seen in the case of the alternative spigot and socket members that the engagement of the anchoring element in the side passage also locks the upper part into the lower part.

The anchoring element is retained in place by an edge flange 41 and a locking flange 42 which engage with a tapered flange 43 extending upward and running along the edge of the lower portions of the spigot and socket members. The tapered flange locks in between the edge and locking flanges of the anchoring element, but also, the face of the distal flange facing the spigot or socket member engages with the outer face of the upper portion or the socket or spigot member, as the case may be, thereby locking the upper and lower portions together.

In the expansion joint formed from sheet metal 62 shown in FIGS. 7 to 9, a similar form is used as in the case of the socket and spigot members. An anchoring portion 38 is divided from the body of the expansion joint members in similar fashion to the embodiment shown in FIGS. 1 to 6. It can also be seen that in both cases of the anchoring element 26 and the anchoring portion 38, formations are provided to provide a keyed engagement in the concrete slab to substantially prevent withdrawal of the anchoring element or portion from the concrete slab. Additionally, both the anchoring element and the anchoring portion are provided at an angle to the dominant plain of the slab to ensure that the anchor is not too close to the surface of the slab, thereby avoiding the possibility that the anchor contributes to failure of the slab. The angle also provides additional anchoring.

The socket and spigot members have a single side web 37*a* from which the top and under flanges extend, the single side web stepping inward at a slanting step 31 to extend downward to a lower fold 33*a*. The lower fold is 180°, the sheet metal extending upward to provide an inside web 35. The sheet metal is further folded to provide an angle flange 39*a* for retaining the temporary seal.

A comparison of an expansion joint is shown in FIGS. 10 to 13 in which the expansion joint is depicted in progressively increasing states of expansion. Temporary keepers 39 are interposed between the expansion joint members. The temporary keepers stretch and eventually break, the secondary sealing of the casting seal 24 shown in other figures not being present in the cross section shown for clarity. Although the temporary keepers may provide some sealing function, this is only incidental; the main purpose of the temporary keepers is to hold the two halves of the expansion joint former together in the appropriate positions for placement in the formwork and casting of the concrete slab.

Figure 14:
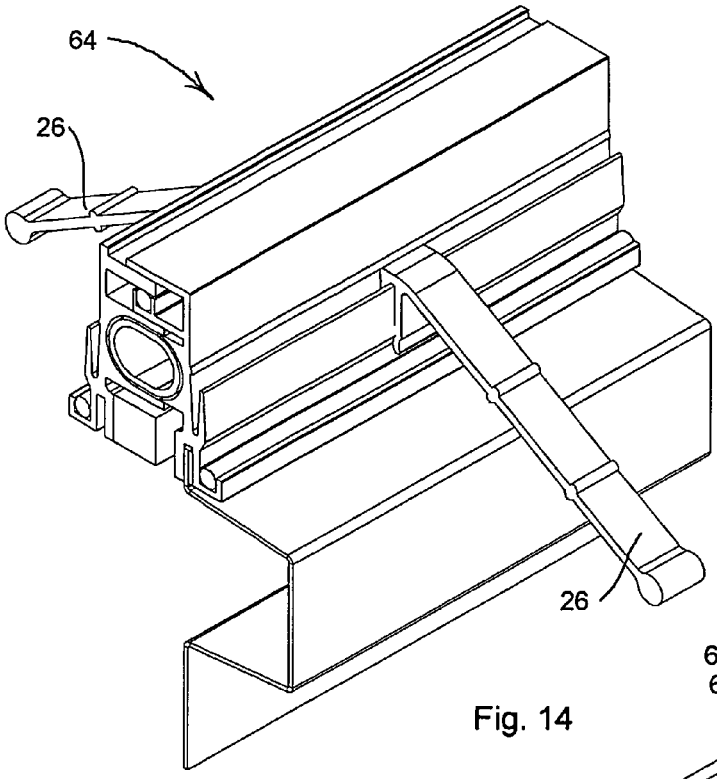
FIG. 14 is a pictorial view of casting elements for an alternative extruded expansion joint having attachable anchors according to the invention.
Figure 16:
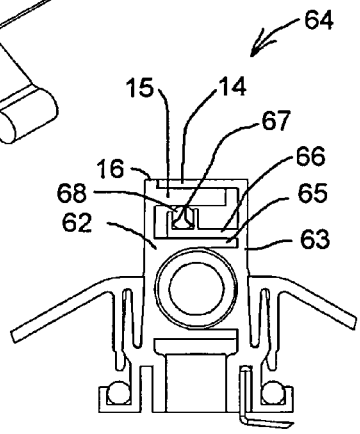
FIG. 16 shows the expansion joint of FIG. 15 in more detail.
Figure 15:
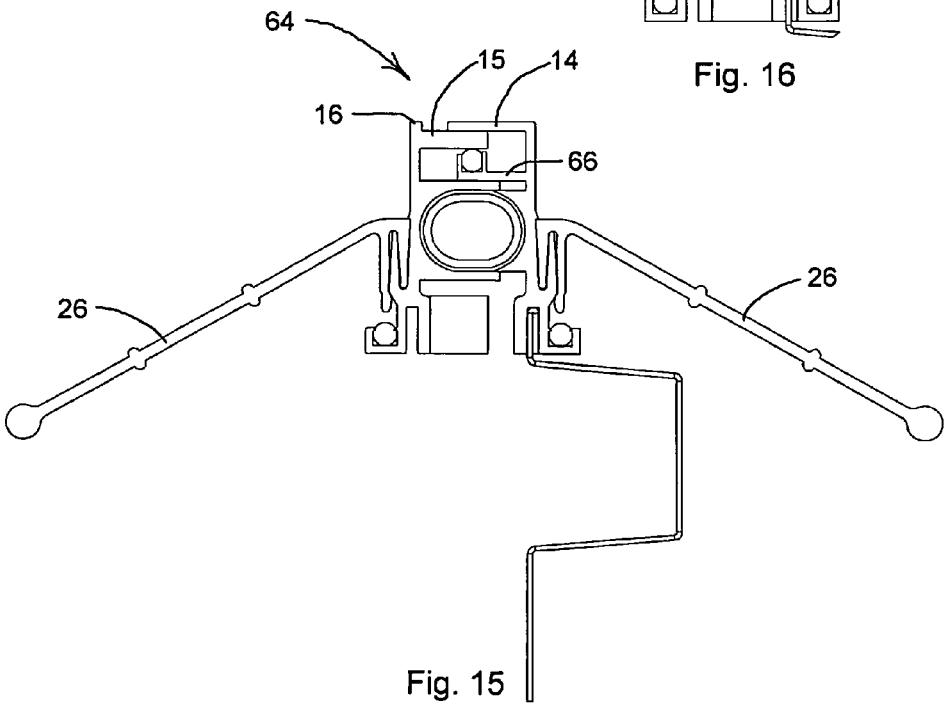
FIG. 15 is a cross-section of the alternative expansion joint of FIG. 14.

The alternative expansion joint 64 shown in FIGS. 14 to 16 is the same in many respects as that shown in FIGS. 1 to 6, and accordingly the same reference numerals are used to refer to like parts. However, the alternative expansion joint includes an alternative spigot member 62 having an under flange 15 extending towards the socket member substantially horizontally in its normal orientation and placement in relation to the socket member. In similar fashion, an alternative socket member 63 includes a top flange 14 extending towards the spigot member and a closing flange 66 substantially parallel to the top flange. The under flange of the spigot member slides under the top flange of the socket member, as well as between it and the closing flange. A socket is effectively formed by the closing flange 66. The alternative spigot member also includes a secondary flange 65 having an upper face which slides against the lower face of the closing flange. The top flange and closing flange both extend towards the spigot member when the socket and spigot members are in their engaged disposition with respect to one another. The closing flange also has distal channel 67 along its distal edge facing towards the under flange for receiving a flange gasket 68 which engages with the lower face of the under flange, thereby sealing the expansion joint.

Figure 17:
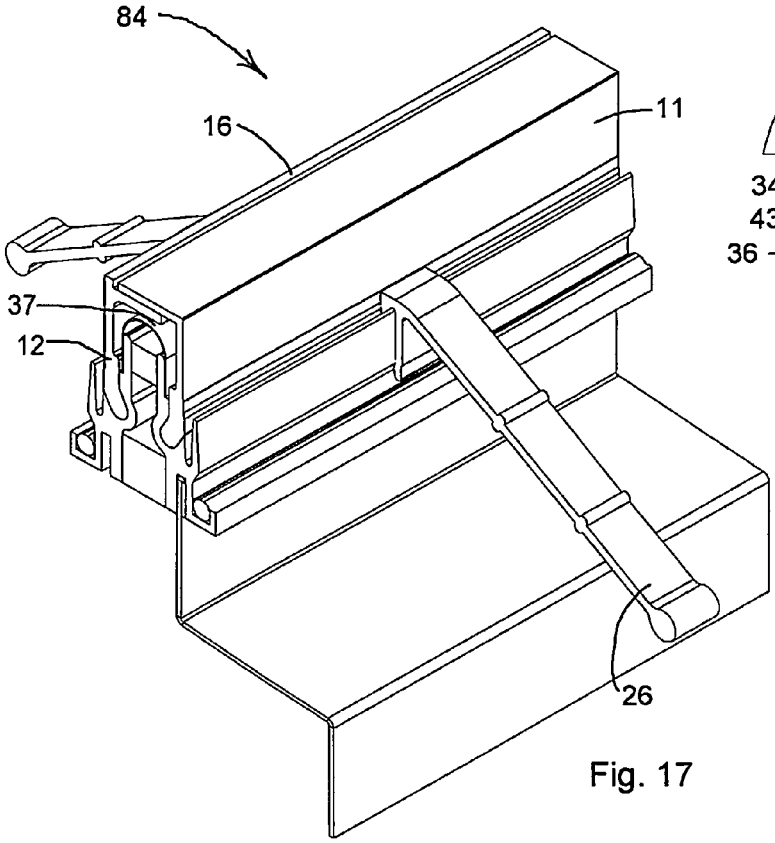
FIG. 17 is a pictorial view of casting elements for an alternative extruded expansion joint having attachable anchors according to the invention.
Figure 18:
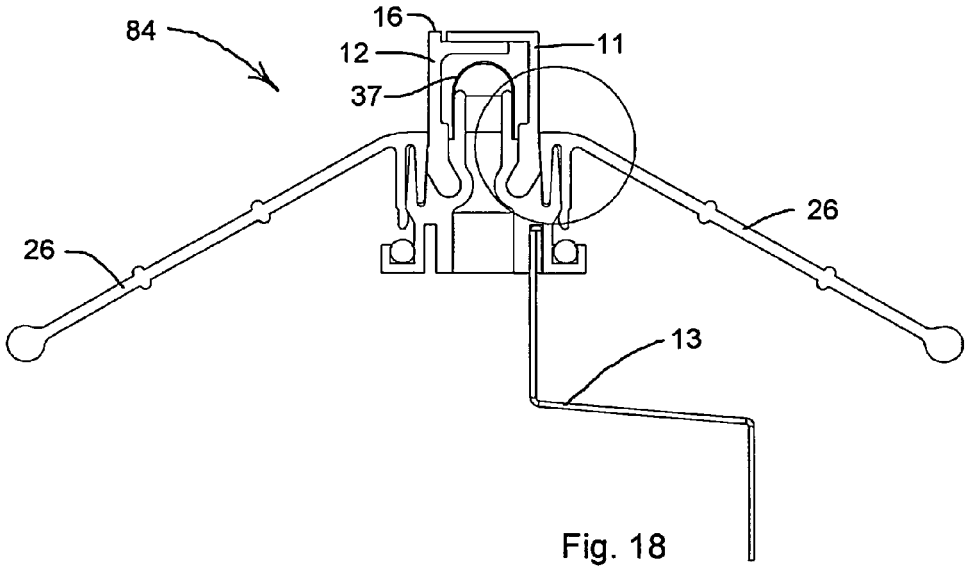
FIG. 18 is a cross-section of the alternative expansion joint of FIG. 17.
Figure 20:
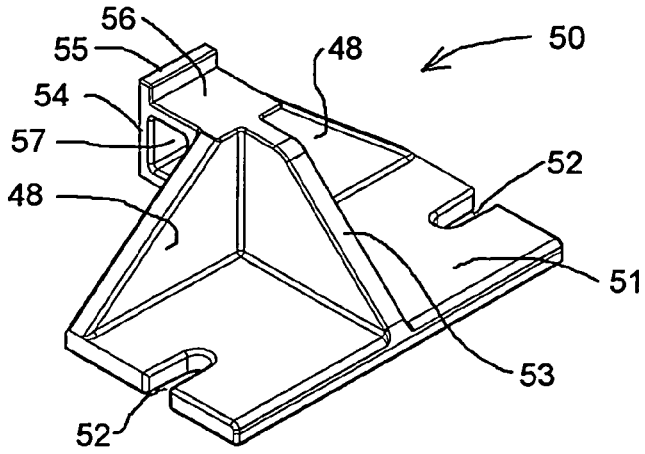
FIG. 20 is a pictorial view of the nail clip of FIG. 18 in a typical installation.
Figure 21:
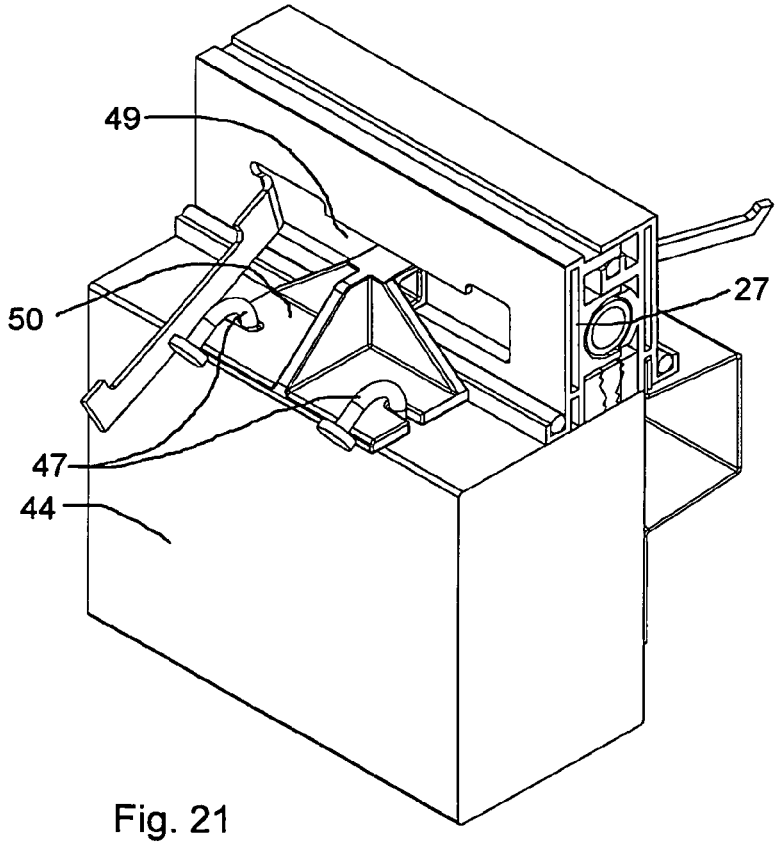
FIG. 21 is a pictorial view showing the nail clip of FIG. 20 in use.

The further alternative expansion joint 84 shown in FIGS. 17 to 19 is the same in many respects as that shown in FIGS. 1 to 6 and that shown in FIGS. 14 to 16. Accordingly, the same reference numerals are used to refer to like parts. However, the further alternative expansion joint has the same spigot and socket arrangement as that shown in FIGS. 1 to 6, but the same arrangement for the anchoring elements as that shown in FIGS. 14 to 16.

In construction of form work, sometimes wooden beams or members are used to support other casting elements. The nail clip 50 shown in FIGS. 20 to 23 includes a rectangular base plate 51 having two opposed fastener slots 52 extending inward from about midway along the shorter sides of the rectangle. A formation is provided on an upper face of the base plate having two triangular side webs 48 along one edge of the base and a central triangular web 53 substantially bisecting the upper face of the base plate, the triangular webs having their respective hypotenuses sloping upward from the edges of the base plate. The triangular webs meet one another midway along the side along which the side triangular webs are formed, rising to meet at an upper face 56. A mounting formation 54 projects from the side of the side triangular webs remote from the central triangular web. The mounting formation includes a mounting lip 55 projecting upward from the edge of the upper face 56, that is, the edge remote from the central triangular web. An aperture 57 also penetrates the mounting formation running the same direction as the mounting lip.

Instead of being anchored by embedding in concrete, the nail clip may be nailed to a wooden casting element 44 by nails 47 or other fasteners through each of the two nail slots 52. The complementary slot is provided in a connecting formation supported above the base by three triangular webs 48. The expansion joint is mounted to the nail clip by inserting the mounting formation through an anchoring formation slot 49 formed by bending the anchoring formation out from the body of the spigot or socket member—the socket member in the example illustrated in FIG. 21—and engaging the mounting lip in the side passage 27.

A corner channel 58 runs along the outer lower corners of each of the spigot and socket members, similar in dimensions to the distal channel 67 of the closing flange 66, for receiving a corner gasket 59 of swellable material. The swellable material is made to swell by contact with water after setting of the concrete of the adjoining slabs. The gaskets have a coating designed to be eliminated by the setting of the concrete, exposing the material for contact with water, thereby effecting sealing of the joint against transport of water across the expansion joint.

Figure 25:
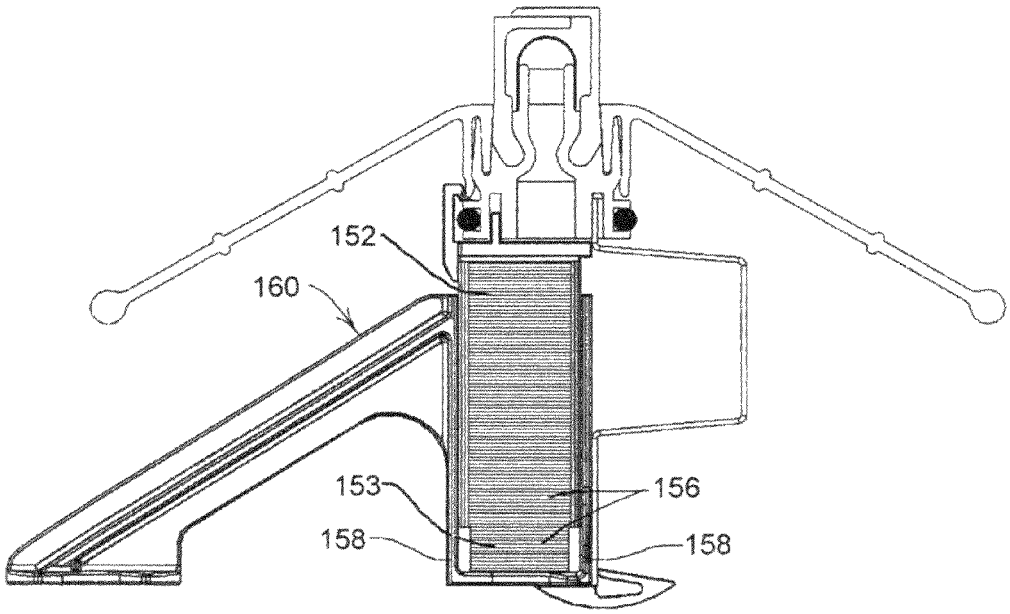
FIG. 25 is a cross section of the form setter of FIG. 24.

The form setter 160 shown in FIGS. 25 and 26 includes a support base 151 and a mounting portion 152. The support base includes an elevation element 153, to support wings 154 extending laterally from the lower end of the support base and a support strut 155 depending downward from an angle from the upper end of the support base. The support base has an elevation element 153 on which the support wings and support strut extend.

On each of the elevation element and mounting portion there is provided a washboard face 156. The washboard face comprises a plurality of ridges and valleys of substantially V shaped cross section running laterally across, the washboard face of the mounting element being of complementary configuration to the washboard face of the elevation element. The mounting portion also includes a pair of edge flanges 157 each of which has a distal lip 159 of larger dimension. The elevation element includes complementary edge slots 158 of equivalent spacing and dimensions to the edge flanges. Each edge slot and has a complementary basal expansion of similar configuration to the distal lip.

The distal lip is of larger dimension than the remainder of the edge flange so that when the mounting element is mounted to the elevation element, it snaps into place at a selected relative axial displacement, or elevation along the elevation element. When so placed, the mounting element is held against sliding axially along the elevation element by virtue of the engagement of the complementary configurations of the opposed washboard faces on each of the mounting element and elevation element. In other words, the ridges of the washboard face of one of the elements engage with complementary valleys of the washboard face of the other element.

In use, the casting elements of the present invention may be used in casting slabs of concrete to provide an expansion joint, including, if required, on site nailing or fixing the casting elements to the remainder of the form work. For longer joints, lengths of the casting elements may need to be joined. A small amount of sealant adhesive, normally a formulation in the form of a paste which can set to form the sealant itself, may be applied to one end of each section of pre-cut sealant to which it would bond, to provide for joining casting elements end-to-end. The expandable tape is provided to overlap the tape of the adjoining casting element to facilitate a continuous seal along conjoined sections of expansion joint. This then becomes a screed rail. Expansion and construction joints received very little longitudinal movement. The use of the invention can provide for the concrete being available for use about 48 hours after completion as against at least one month for conventional methods.

In order to install the casting elements of the present invention, the key former is connected to one of the expansion joint members, usually the socket member, but not necessarily so. The displaced portion has its convex side directed into the casting and away from the other expansion joint member. In order to set the form at the appropriate elevation above the base of the concrete casting, the mounting portion is fixed to the expansion joint member which is not attached to the key former and once the elevation of the form work is set, the mounting element may be attached to the support base by clipping into place so that the respective washboard faces of each element engage. At the same time, the lower lip of the key former is engaged in a lower clip 61 extending from the base of the elevation element in the opposite direction from that of the support strut. The casting elements according to the invention permit, inter alia, the key former to be precisely located at a desirable position, a screed rail for accurate forming of the upper surface of the slab, and a straight edge to the casting.

The concrete slab may be cast with the casting elements in place, and remain embedded in the concrete. The hydrophilic strip is coated with a temporary coating which when dissolved permits moisture to be absorbed, thereby causing the hydrophilic strip to expand into the expansion joint to seal same. The dissolution or disintegration of the coating may occur as a result of exposure to water after setting of the concrete, and/or as a result of the exposure to water used in the concrete mixture which ultimately sets to form the slab. It will be appreciated that expansion joints may be formed using the casting elements of the present invention without a key former.

Although the invention has been described with reference to a range of specific examples, it will be appreciated by those skilled in the art that the invention may be embodied in other forms within the broad scope and ambit of the invention as herein set forth and defined by the following claims.

The invention claimed is:

1. Concrete casting elements for forming an expansion joint in concrete including:

a pair of expansion joint members each having an expansion joint recess with a gasket engaging face extending from along one side of the expansion joint recess and opposed to the other expansion joint member recess engaging face;

a compressible gasket mounted between the faces for sealing the joint;

an expansion joint flange extending from a portion along one side of each expansion joint member;

the flange of one joint member at least partly overlying the flange of the other joint member to provide an expansion joint upper face such that remaining portions may be spaced from one another when the flanges are so engaged;

one flange including an upwardly extending lip coplanar with the expansion joint upper face; and retainer mounting means formed onto or into said remaining portion for mounting one or more retainer elements to protrude from the opposite sides of the expansion joint member.

2. Concrete casting elements according to claim 1, wherein the retainer mounting means is formed as a channel into which a complementary retainer mounting formation may be inserted.

3. Concrete casting elements according to claim 1, wherein the retainer mounting means for the expansion joint recess member is arranged for mounting one or more retainer elements to protrude from the opposite side of the recess member from the opening of the recess; and the retainer mounting means for the expansion joint flange member is arranged for mounting one or more retainer elements to protrude from the opposite side of the flange member from the flange; and the flange is formed to have a cross-section complementary to the elongate recess, whereby the flange may be inserted into and withdrawn from the recess as the expansion joint members move towards and away from one another in a substantially parallel relative disposition with respect to one another;

and the expansion joint flange member constituting the other expansion joint member having the lip substantially coplanar with the expansion joint upper face.

4. Concrete casting elements according to claim 1, and including:

a key former having substantially parallel straight side edges; and a mounting groove extending along an edge of either or each remaining portion of the expansion joint member for mounting one or either expansion joint member to a side edge of the key former.

5. Concrete casting elements according to claim 1, and including:

a key former having substantially parallel straight side edges; and a mounting groove extending along an edge of either or each remaining portion of the expansion joint member for mounting one or either expansion joint member to a side edge of the key former.

6. Concrete casting elements according to claim 1, and including:

a sealant receiving formation extending substantially along the joint recess and the joint flange member in respect of which a water-expandable sealant may be received to be operatively disposed in the expansion joint.

7. Concrete casting elements according to claim 1, and including a substantially straight edge formed along either expansion joint member at a disposition suitable for use as a screed rail.

* * * * *